US005461761A

United States Patent [19]

Knöpfli; Bruno et al.

[11] Patent Number: 5,461,761

[45] Date of Patent: Oct. 31, 1995

[54] PROCESS AND APPARATUS FOR THE PRODUCTION OF EXPANDED GRIDS

[75] Inventors: Bruno Knöpfli, Allschwil; Ulrich Bühlmann, Biel-Benken, both of Switzerland

[73] Assignee: Kuhni AG., Allschwil, Switzerland

[21] Appl. No.: 156,853

[22] Filed: Nov. 24, 1993

[30] Foreign Application Priority Data

Nov. 24, 1992 [CH] Switzerland ..... 3596/92

[51] Int. Cl.[6] ..... B21D 31/04; B21D 47/00

[52] U.S. Cl. ..... 29/6.1; 72/234

[58] Field of Search ..... 29/6.1, 6.2; 72/226, 72/234, 377, 378

[56] References Cited

U.S. PATENT DOCUMENTS

| | | | |
|---|---|---|---|
| 3,455,135 | 7/1969 | Allen | 72/187 |
| 3,570,086 | 3/1971 | Stone | 29/6.2 |
| 4,105,724 | 8/1978 | Talbot | 261/112 |
| 4,305,187 | 12/1981 | Iwamura et al. | 29/6.1 X |
| 4,921,118 | 5/1990 | Gass | 29/6.1 X |
| 5,063,647 | 11/1991 | Rohrer et al. | 29/6.1 |
| 5,199,142 | 4/1993 | Davis | 29/6.1 |

FOREIGN PATENT DOCUMENTS

| | | |
|---|---|---|
| 0069241 | 9/1985 | European Pat. Off. . |
| 926424 | 4/1955 | Germany . |
| 1944273 | 3/1971 | Germany . |
| 2120138 | 11/1983 | United Kingdom . |

*Primary Examiner*—S. Thomas Hughes
*Attorney, Agent, or Firm*—Brady, O'Boyle & Gates

[57] ABSTRACT

A sheet-metal strip provided with mutually staggered cuts is conveyed continuously at a first speed through a first conveying apparatus (23) and at a second speed, increased as related to the first speed, through a second conveying apparatus (24). Thereby, the strip section (21) freely traveling between the first and second conveying apparatus (23, 24) is stretched with the formation of a three-dimensional expanded grid structure. The process permits a continuous, rapid production of expanded grids of high precision and uniformity, especially with regard to mesh width and grid height.

24 Claims, 3 Drawing Sheets

PROCESS AND APPARATUS FOR THE PRODUCTION OF EXPANDED GRIDS

BACKGROUND OF THE INVENTION

The invention relates to a process and apparatus for the production of expanded grids in accordance with the preambles of the two independent claims, as well as to an expanded grid produced pursuant to the process.

The manufacture of expanded grids (also called expanded metals) is based conventionally on the plastic (inelastic) deformation of metal strips provided with staggered cuts. A vertically and laterally movable cutter bar is usually employed for the production of expanded grids (compare, for example, U.S. Pat. No. 3,570,086). The cutter bar, by means of the vertical movement, cuts into a sheet-metal web to produce mutually spaced-apart cuts transversely to the longitudinal direction of the web and, during the further course of the cutting motion, simultaneously stretches the transverse strip of the web that has been freed by the cuts to the required dimension; during this process, the expanded metal is not only bent (inelastically) but also stretched. Thereafter, the cutter bar is laterally displaced with a simultaneous advancing of the sheet-metal web in order to form, with a renewed vertical cutting and stretching motion, the subsequent, staggered cuts and to expand the next transverse strip.

The customary manufacturing procedure can be applied solely to thick metal. Thus, a sheet-metal thickness is required which is large in relation to the bridging web width (compare FIG. 12 of U.S. Pat. No. 3,570,086). And this process permits only the production of relatively coarse grid structures with limited accuracy.

The process cannot be applied to thin sheet-metal strips, as necessary, for example, for the production of the lamellar grids of the packings of mass transfer columns wherein the ratio of grid web thickness to grid web width must be very small (EP-B 0 069 241). In this procedure, no stretching is possible, and the grid webs would tear at the nodal points when using the conventional process.

Such lamellar grids thus had to be manufactured heretofore in an expensive fashion individually by pulling apart the outer rims of a sheet-metal strip provided with staggered cuts (EP-B 0 069 241). The accuracy and, above all, regularity of the grid structure, especially important for the effect of the packings of mass transfer columns, could not be achieved herein, or could be attained only incompletely.

U.S. Pat. No. 4,105,724 discloses a process of another kind wherein a synthetic resin sheeting of PVC is provided with staggered cuts, heated in a heating chamber, and pulled out of the heating chamber faster than being fed into the latter, resulting in a cellular structure which is subsequently hardened by cooling. This is not an expanded-grid method but rather a thermoplastic method. An exactly defined and uniform grid form is neither intended nor achievable in this process inasmuch as the grid exiting from the chamber can still be readily deformed during transport prior to solidification.

Methods of some other type wherein the stretching of the grid or of the perforated metal strip takes places transversely to the conveying or manufacturing direction are furthermore known from GB-A 2 120 138, DOS 19 44 273, and U.S. Pat. No. 3,455,135.

Finally, German Patent 926,424 demonstrates how metal strips can be provided with linear slots by means of revolving cutting wheels.

SUMMARY OF THE INVENTION

It is an object of the invention to manufacture continuously expanded grids at high precision and uniformity, especially with respect to mesh width and grid height.

Mesh width and grid height herein are to be selectable—insofar as possible—independently of each other and—once preselected—the endless manufacture of a grid strip of arbitrary length having an exactly identical and exactly uniform grid structure is to be ensured.

The advantage of the process of this invention is to be seen, in particular, in that each mesh is formed and stretched in an exactly identical fashion so that an absolutely regular grid is obtained with high precision of mesh width and grid height.

The process according to this invention is especially suited for the production of special expanded grids wherein high precision and regularity of the grid structure (mesh width, grid height, etc.) are important, particularly the lamellar grids utilized in accordance with EP-B 0 069 241 for packings of mass transfer columns. As described in EP-B 0 069 241, a very thin starting material must be utilized for such grids wherein, differently from the case of customary expanded metal grids, the width of the lamellae (grid webs 8 in FIG. 1 of the appended drawing) is substantially larger than their thickness.

The process and apparatus for the production of expanded grids according to this invention will be described hereinbelow with reference to the drawing, using a simple embodiment.

DESCRIPTION OF THE PREFERRED EMBODIMENT

The sheet-metal strip 2, prior to being processed into the expanded grid in the apparatus shown in FIGS. 4–7, is provided with staggered cuts by means of a cutting and punching device (not shown).

Figure 1:
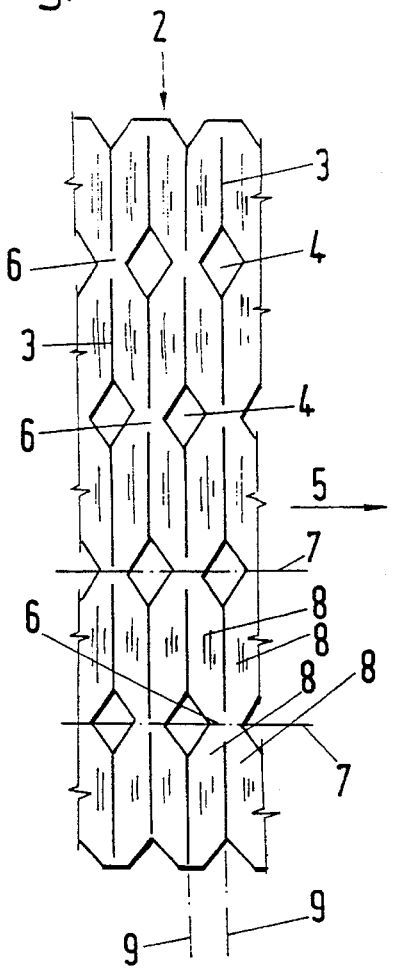
FIG. 1 is a top view of a still unstretched sheet-metal panel section provided with staggered cuts.
Figure 2:
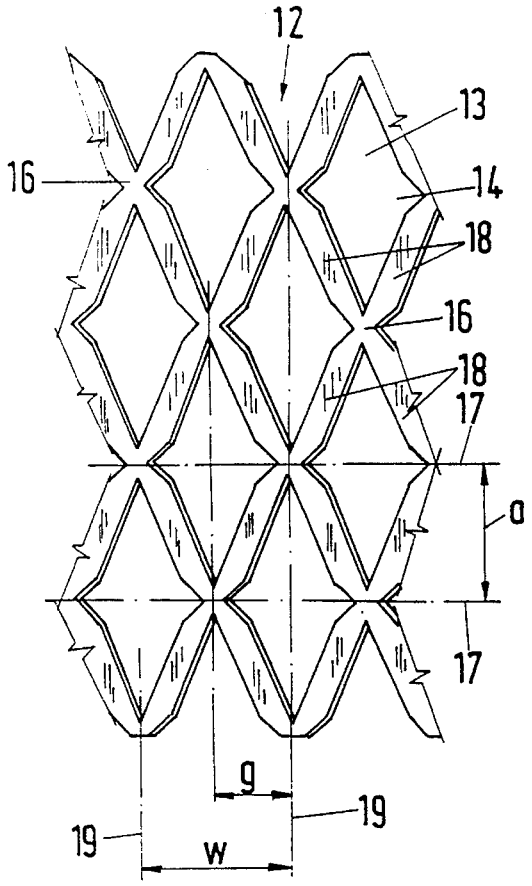
FIG. 2 is a top view of the expanded grid section formed from the sheet-metal panel section of FIG. 1.

The form and position of the cuts in the (still unstretched) length of sheet metal 2 can be seen from FIG. 1 (see also the corresponding FIG. 8 of EP-B 0 069 241). These are mutually parallel cutting line sections 3 of identical length, enlarged in the center of the section into a rhombic cutout 4 and offset by half the length with respect to the sections 3 adjacent in the longitudinal strip direction (conveying direction) 5. The sheet-metal length 2 of FIG. 1 furthermore reveals the nodal points 6, the nodal rows 7 and nodal columns 9 indicated by dot-dash lines, as well as the respectively four webs 8, adjoining a nodal point 6, of the expanded grid 12 to be formed, illustrated in FIG. 2.

Figure 3:
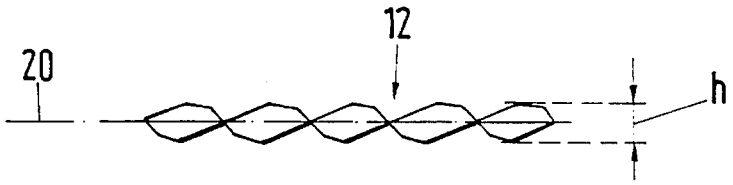
FIG. 3 is a greatly simplified lateral view, indicated merely in its contours, of the expanded grid section of FIG. 2.

Referring to the grid, 13 denotes the meshes, 14 denotes the cut-open space of the meshes 13, formed from half the cutout 4, 16 denotes the nodal areas, 17 denotes the nodal rows, 18 denotes the grid webs, 19 denotes the nodal columns, a denotes the nodal row spacing, g denotes the nodal column spacing, and w denotes the mesh width. The nodal points 6 and, respectively, nodal areas 16 are understood to represent the entire transition zone between the webs 8, 18, including the edges defining the cutouts 4, 14. The grid height h can be seen from FIG. 3; the angle of inclination n of the nodal areas 16 with respect to the grid plane 20 can be seen from FIG. 6.

The thickness of the length of sheet metal 2 is suitably 0.15–0.3 mm, the width of the grid webs is, for example, 6 mm. The ratio of the width of the grid webs 18 to their thickness is thus substantially larger than in case of conventional expanded grids.

The apparatus for producing expanded grids consists of three conveyors 23, 24, 25, spaced apart from each other in the conveying direction 5 respectively by a sheet-metal length or grid panel section 21, 22 of, for example, several decades of the mesh width w, these conveyors transporting the sheet-metal or grid panel 2, 12 in succession, and a sizing means 26 for setting the grid height.

The sheet-metal strip 2 can be fed into the apparatus directly from the cutting and punching device (not illustrated). The finished grid 12 is best sheared off to the desired grid length directly downstream of the apparatus with the aid of a cutter 10.

The (constant) conveying speed of the second conveyor 24 is increased as related to the (likewise constant) conveying speed of the first conveyor 23. And also the (constant) conveying speed of the third conveyor 25 is increased with respect to that of the second conveyor 24. The conveying speed of the sizing means 26, in contrast thereto, corresponds to that of the preceding conveying means 25.

All three conveyors 23, 24, 25 are basically of identical construction insofar as they are designed for engaging the cuts 3, 4 of the length of material 2 and/or the meshes 13, 14 of the grid panel 12 produced therefrom. The structural design of the conveyors 24, 25 is entirely the same herein; for this reason, the latter conveyor will first be described in detail, through which passes the grid 12 in the finished form but with the height not as yet sized. This conveyor consists of a pair of rolling elements 30, 31 exhibiting projections and recesses meshing in the manner of a gear wheel. Looking at the arrangement in greater detail, each of the two rolling elements 30, 31 is made up of a number of toothed disks 33–38 corresponding to the number of nodal rows 17 and seated on a joint shaft 32. (In the simple embodiment described herein, the grid 12 has only six nodal rows 17, and for this reason there are also only six toothed disks 33–38; however, under practical conditions, the number will, of course, be higher.) The central planes of the toothed disks 33–38 are spaced apart from each other in correspondence with the nodal row spacing a. The nodal points 16 of the first, third, and fifth nodal rows 17 extend between the respectively converging tooth flanks 39, 40 of the first, third, and fifth toothed disk pairs 33, 35, 37. The tooth flanks 39, 40 of these toothed disk pairs thus are aligned with each other transversely to the conveying direction 5. The tooth flanks 39, 40 of the second, fourth, and sixth disk pairs 34, 36 and 38 are offset in the peripheral direction 41 by the nodal column spacing g with respect to those of the first, third, and fifth disk pairs 33, 35, 37, in order to accommodate the nodal areas 16 of the second, fourth, and sixth nodal rows 17.

Figure 6:
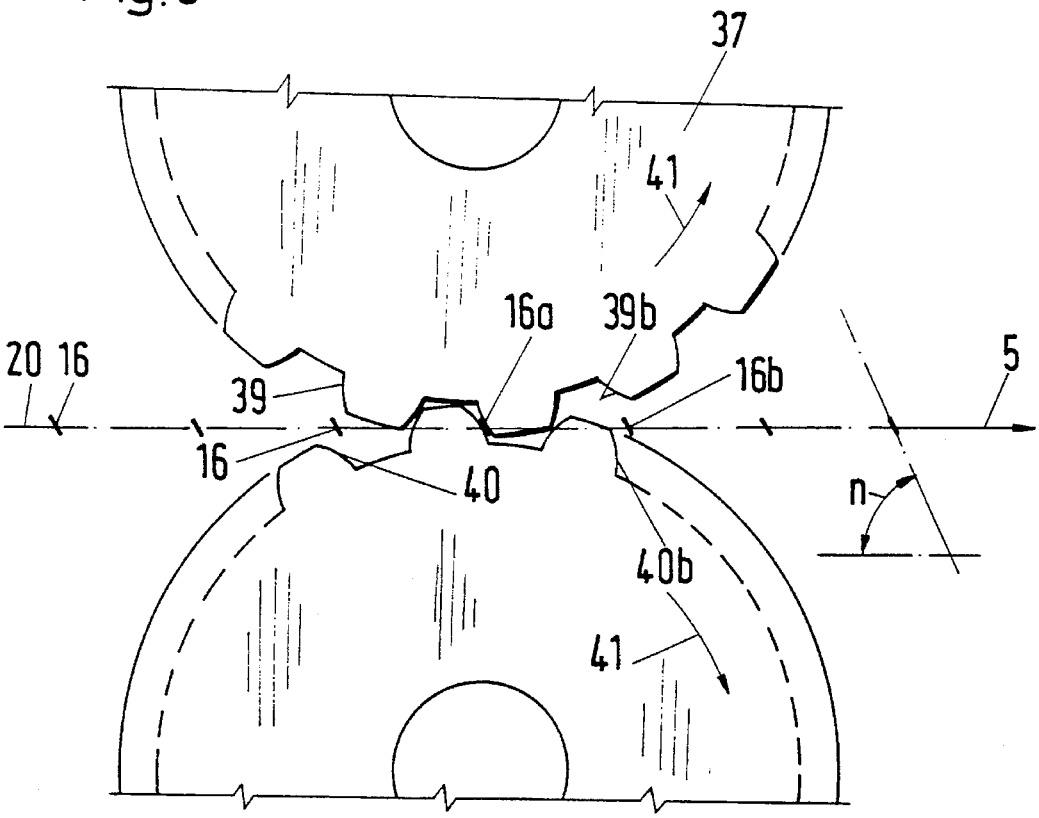
FIG. 6 is a section along line VI—VI in FIG. 5, on an enlarged scale.
Figure 7:
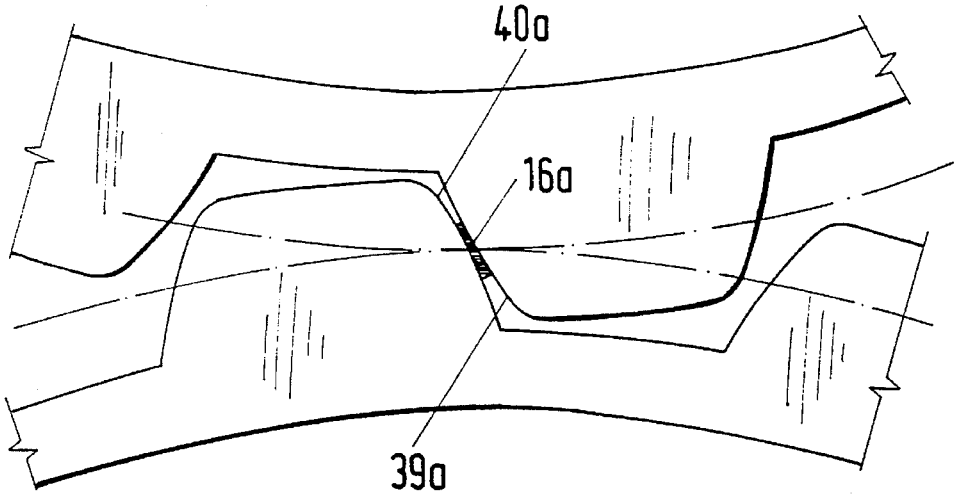
FIG. 7 shows an enlarged fragmentary view of FIG. 6.

FIGS. 6 and 7 show how the nodal surface 16 extends in between two respectively cooperating tooth flanks 39, 40 of a disk pair while the preceding nodal area 16*a* comes to lie between the two tooth flanks 39*a*, 40*a*, and the next-forward nodal area 16*b* exits from the tooth flanks 39*b*, 40*b*. The teeth are designed in such a way, and the mutual arrangement is such, that the tooth flanks roll over the grid nodal areas 16, which latter exhibit the angle of inclination n with respect to the grid plane 20 resulting from the grid geometry and the produced stretching step, in a rolling process similar to an involute gearing, whereby the three-dimensional grid is retained without any impairment and is simultaneously transported linearly and in a straight line.

It is understood that the peripheral spacing or the number of teeth are to be adapted to the respectively desired mesh width w (or the nodal column spacing g, respectively), dependent, in turn, on the nodal row spacing a. (The larger the nodal column spacing g, the smaller the nodal row spacing a.)

The centers of the toothed disks 29 of the preceding conveyor 24 are consequently arranged at a distance from one another in correspondence with the nodal row spacing a which there is larger. And the tooth spacing (in the peripheral direction of the disk) is also smaller in correspondence with the nodal column spacing g which there is smaller.

The conveyor 23, which does not exert any traction, is designed to be still somewhat simpler. It consists of a pair of rolls 28 which is driven (in the same way as the conveyors 24, 25) and which transports the sheet-metal strip 2 without slippage against the traction of the second conveyor 24. The rolls 28, for this purpose, exhibit (in a merely schematic illustration) projections 27 designed, for example, to be of a nub shape, and corresponding recesses which mesh with one another. The nubs or projections 27 engage into the cutouts 4 and thus secure the sheet-metal strip 2 against slippage in a simple way.

As mentioned above, the conveyor 23 is fashioned basically identical, namely for engaging into the cutouts 4 of the length of material 2, as the subsequent conveyors 24, 25 engaging into the corresponding cutout spaces 14 of the grid panel 12. The remarks made in connection with the teeth of the toothed disks 29, 33–38 thus also apply analogously to the nubs or projections 27 and recesses of the rolls 28. Correspondingly, the axial spacing of the nubs or projections 27 in the conveyor 23 is larger than the spacing of the toothed disks 29 in the conveyor 24,and the peripheral distance of the nubs or projections 27 is smaller than that of the teeth of the toothed disks 29.

Figure 4:
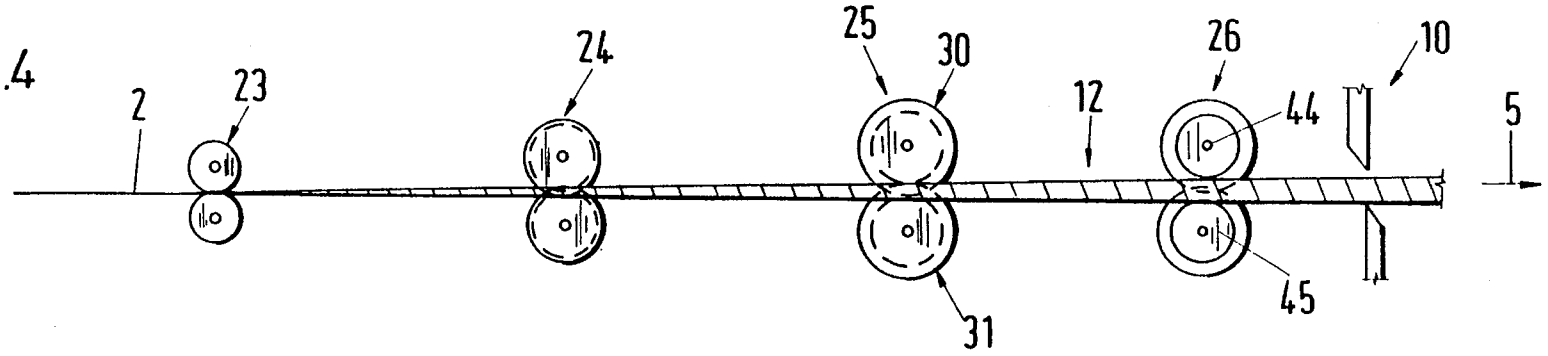
FIG. 4 is a schematic lateral view of the apparatus.
Figure 5:
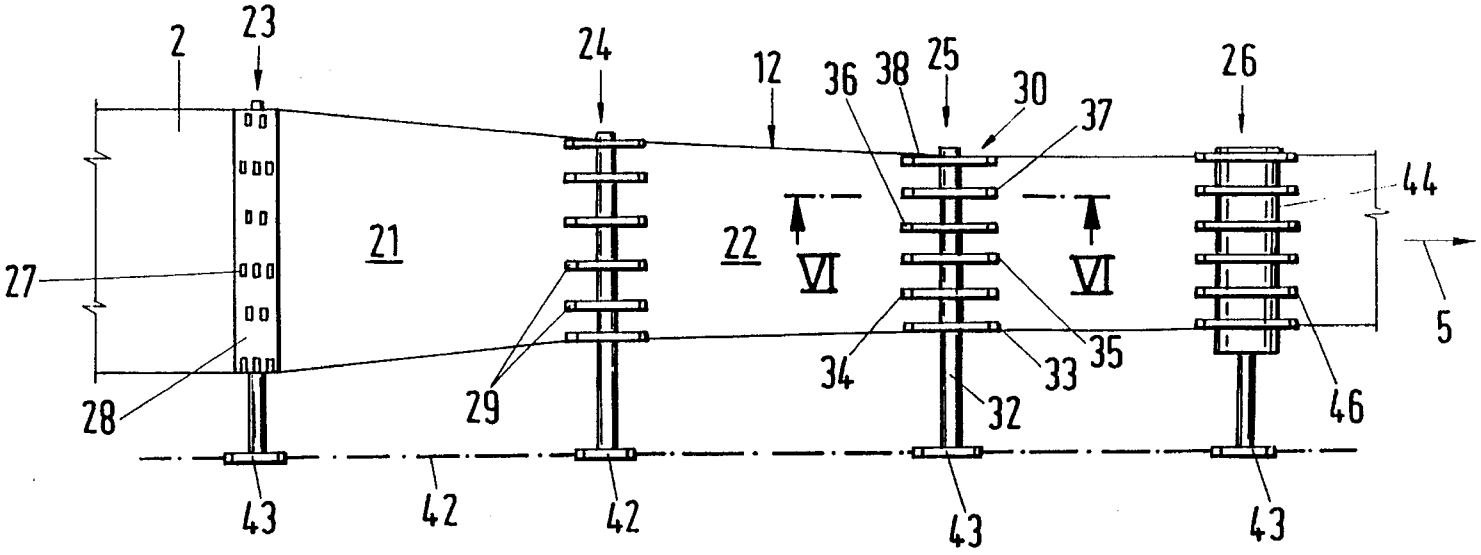
FIG. 5 is a schematic top view of a portion of the apparatus.

In spite of the differing peripheral spacing, the toothed disks 29, 33–38 of the conveyors 24, 25 exhibit the same number of teeth. The differing tooth spacing in the conveyors 24, 25 is thus obtained by a different disk diameter, as schematically indicated in FIGS. 4/5. This makes it possible to drive the shafts 32 of the conveyors 24, 25 jointly at the same number of revolutions, namely simply with the aid of a chain drive 42 by way of chain wheels 43 seated on the shafts 32. The same holds true analogously for the projections of the rolls 28 likewise driven by the chain drive 42. These rolls and the toothed disks 29, 33–38 can, however, also exhibit a varying number of projections and/or teeth and can be driven individually.

The sizing means 26 for the calibration of the grid height consists of cylinder jackets 44, 45 rotating at a mutual distance corresponding to the desired grid height h, the grid 12 being guided through between these cylinder jackets. The sizing means 26 has the same structure as the conveyor 25, i.e. it has, just as the latter, toothed disks 46 engaging at the nodal areas 16; these disks—because they rotate at the same conveying speed as the toothed disks 33–38—do not serve for traction but rather for further transport. The only difference is the much larger diameter of the shafts (cylinder jackets) 44, 45 in the pass-through zone of the grid 12, between which the sizing gap having the height h is formed so that webs 18 extending past this height are pressed back into the correct position. An especially accurate sizing is attained by stretching the grid 12 by means of the conveyor 25 to precisely such an extent that it is throughout slightly higher than the sizing nip between the cylinder jackets 44, 45. The sizing of the grid height h is facilitated by the cutouts 4. Thanks to the latter, the webs 8 thus can simply be twisted about their diagonal, without experiencing any deformation themselves, in that the bending edges surrounding the nodal area 16 are further deformed whereby the grid height is directly reduced.

The process performed by means of the apparatus can be described as follows:

The still unstretched sheet-metal strip 2 provided with the cuts 3, 4 is transported with the aid of the conveyor 23 continuously (uniformly) and at the same (constant) first speed at which it passes through the cutting and punching device (not shown). The conveyor 23 transports the strip 2 without slippage, i.e. retains same with the aid of the projections or nubs 27, engaging into the cutouts 4 of the strip 2 (and into the recesses of the counter roll), against the pull of the more rapidly conveying second conveyor 24.

Basically the same process takes place with the conveyor 24, but at the second conveyor speed increased as related to the first speed; this conveyor, however, acts as a traction means due to the speed difference so that the panel section 21 freely traveling between the conveyors 23/24 is gradually stretched with formation of a three-dimensional expanded grid structure. (Freely traveling means that the length of material can be freely deformed. Of course, a merely supportive sliding surface or the like, for example, would not be prohibitive herein.) The tooth flanks of the toothed disks 29 roll over the nodal areas 16, presently inclined due to the stretching step, the thus-produced three-dimensional grid being retained and transported in linear and straight-line fashion.

Subsequently to the first stretching step, a second, basically identical stretching step is performed. The expanded grid section 22 is further stretched between the second and third conveyors 24 and 25 in that also the third conveyor 25 operates at an increased conveying speed as related to the second conveyor 24, thus exerting a pull on the grid section 22.

The sizing means 26, finally, takes care of retaining the grid and transporting same, and simultaneously sizing its height, as already described above.

It is to be noted that the grid is seized only at the grid nodal points, namely preferably at all grid nodal points in order to ensure a uniform grid formation. The tooth shape, especially the tooth width, is chosen herein (compare FIGS. 6/7) so that the tooth flanks engage only at the central, planar region of the inclined nodal areas 16 and roll thereover. Thereby, the adjoining grid webs 8 can likewise orient themselves as inclined surfaces 18 by way of four bending edges directly defining the nodal point 16. Care must be taken that all toothed disks are correctly adjusted and are in exact alignment. Of course, in the dimensioning of the toothed disks, attention must also be directed toward having in all cases a nodal column 19 in engagement between the tooth flanks. Otherwise, a constant retention and continuous transport of the grid would be impossible.

It should also be pointed out, in connection with the above-described simple embodiment of the expanded grid manufacture, that the invention has made use, for this especially simple production and manufacturing device, of the (actually conventional) cutouts 4 at the nodal points 6 in a special way. This is so because the cutouts 4 are utilized for the timely unhindered introduction and retraction of the teeth of toothed disks dimensioned maximally large in diameter into and out of the grid structure so that there is at all times a nodal column 9 in engagement between two tooth flanks. The above remarks have already pointed out the utilization of the cutouts 4 with respect to simplification and advantages in grid height calibration, and the feature of securing against slippage at the first roll pair 28 by means of the projections or nubs 27 has likewise been discussed.

The advantages of the disclosed manufacturing process and of the apparatus, distinguished especially by the conveyor 24 and 25, respectively, effective as a traction roll adapted to the grid structure, are to be seen especially in the following:

Each grid section is treated in a completely identical fashion. The grid is continuously fixed and positioned. And transport is effected, rather than in a jerky fashion, uniformly with a conveying speed that gradually increases in the region of the sections 21, 22. The three-dimensional grid shape resulting from the mere stretching step can be influenced and altered (of course only within certain limits) by the configuration of the roll, thus, for example, the grid height by means of the sizing unit 26. Thereby, the desired grid can be manufactured with the required precision.

A special advantage of the herein-described simple embodiment illustrated in the drawings is furthermore to be seen in that it is possible to produce precise grids of arbitrarily selectable mesh width with economical means, namely toothed-disk rolls that can be produced in a simple way.

Another advantage resides in the high production speed attainable thanks to the continuous, uniform rotation of the conveyors.

The manufacturing process can be interrupted at any time wherein the grid can be arrested in any desired position without impairing its quality. Thus, the grid can also be produced intermittently instead of continuously, for example in order to be able to cut off a finished grid section each time the grid is at a standstill.

It is, of course, also possible to work with only one stretching step, especially in case of not very high requirements regarding precision and uniformity of grid structure; in other words, the conveyor 25 and also the sizing means 26 can be omitted. In order to improve still further the required high precision and uniformity regarding mesh width and grid height, particularly in case a very large mesh width and a correspondingly large angle of inclination are desired, it is, however, also possible to work with even more than two stretching steps, i.e. additional conveying means acting as traction means can be provided following the conveyor 25, these conveying means placing the grid stepwise into the desired final form. It is furthermore possible to utilize several sizing means which can also be arranged between the conveyors acting as pulling means and which transport at the same or at an increased velocity as compared with the preceding conveyor.

Depending upon requirements, the sizing means 26 can also operate at a higher conveying speed than the preceding conveyor in order to act simultaneously as a traction means. An especially accurate sizing of the grid height is, however, attained in accordance with the embodiment wherein the grid is stretched by the conveyor 25 to such an extent that the grid height is larger than the sizing nip width between the barrels 44, 45, and sizing means 26 as well as conveyor 25 operate at the same conveying speed.

The mesh width M and grid height h governing for the grid structure can be precisely preselected by means of the process according to this invention, the mesh width by a corresponding choice of the quotient of the conveying speeds of the conveyors 24, 23 and 25, 24, the grid height h by the spacing (sizing gap) of the cylinder barrels 44, 45 of the sizing means 26. (The grid height increases during stretching, i.e. with the mesh width, but can be reduced with the aid of the sizing means as compared with the setting resulting automatically during stretching.) In the embodiment, the velocity quotients are determined by the construction. Of course, the velocity quotients could, however, also be freely selectable by individually controlled conveyors driven independently of one another, in order to be able to produce in quick succession grids having differing mesh width (and thickness).

The apparatus shown in FIGS. 4–7 can furthermore include an exchangeable feeding drum onto which the strip 2, provided with the cuts 3, 4, is wound up, the strip being continuously taken off the feeding drum and being introduced into the conveyor 23.

At least the conveyor or conveyors acting as traction means, i.e. the conveyors traveling at a conveying speed higher than the preceding conveyor, can also consist of respectively one positive and negative roll imaging the entire grid in three-dimensional fashion. Since these rolls can be produced practically only by means of a relatively expensive three-dimensional erosion process, this embodiment will be contemplated, above all, in case of special grids to be formed from sheet-metal lengths with cuts/recesses 3/4 of a complicated configuration, or in case of grids with grid webs to be formed in a special way. The grid, three-dimensionally preformed already on the way to the pair of rolls acting as the pulling means, will in this case likewise be held and transported (as in the embodiment illustrated in the figures) during passage between the positive and negative roll in a rolling procedure. In this way, different sizing rolls are made possible, for example also those which increase the grid height subsequently to the disclosed, simple grid producing device 23–25. In contrast to the embodiment described in connection with the figures, such positive and negative rolls can engage not only at the grid nodal points but also at the grid webs and any other, particularly configured grid portions. In this connection (differently from the described simple embodiment), it is also possible to calibrate the grid form, i.e. to influence the grid form by shaping between the two rolls, and thus to bring the grid into a desired, sized final shape.

Accordingly, sizing means, within the scope of the invention, any deformation of the grid, from the setting of a single grid parameter, such as the height h, up to the shaping of the entire grid structure into a desire, exactly determined three-dimensional final configuration.

The positive and negative rolls can, of course, also be designed in a simpler way, namely so that they engage only at certain parts of the grid, for example analogously as in case of the toothed disks 33–38 only in the region of the nodal points of the grid. However, in contrast to the toothed disks 33–38, the entire three-dimensional nodal point, including the bending sites surrounding this point and forming the transition to the grid webs, will be imaged in the roll pair in a positive and negative form. The roll pair can also engage merely at the grid webs and thereby place them into a specifically desired shape. As mentioned above, it is possible in this way to bring about also merely a simple height calibration, but also to a larger grid height. Furthermore, it is also possible to utilize as the conveyor a pair of rolls, one roll of which carries nubs engaging into the cutouts 4 and the other roll of which exhibits corresponding holes. Furthermore, it is also feasible to employ as the conveyor merely one rotational element provided with nubs or other projections.

As mentioned above, it is possible in the process of this invention to obtain various advantages by the use of sheet-metal strip provided not only with the simple customary cuts 3 but additionally with the rhombic or also other, e.g. circular, cutouts 4. The process can, however, also be performed with sheet-metal strip cut merely in the customary way. Furthermore, the expanded grid can also be made of a nonmetallic material, presupposing that the plastic deformability of the length of material required for expanded grid manufacture is ensured.

The above-described, preferred embodiments of the invention are based on the following basic considerations, made within the scope of the invention, with regard to the design of the conveyors:

The conveyors are to transport and/or pull the length of material or grid continuously (uniformly) at a uniform speed, and consequently in uninterrupted and above all jerk-free fashion. And the length of material is to be conveyed without slippage, for the invention is based on the realization that any even only slightly jerky transport and any slippage can impair the uniformity and precision of the grid structure.

Correspondingly, two ideas form the basis for the conveyors preferred according to this invention. First of all, rotational elements, preferably rotational element pairs (rolling element pairs) rolling upon each other, operating at a constant speed, are utilized as the conveyors, affording assurance of a uniform drive. Secondly, the rotational elements are designed for a slip-free drive of the length of material or grid, namely so that at least the second and further conveyors correspond to the grid structure, i.e. do not impair the latter. This is realized by imagining that the grid structure is reproduced three-dimensionally onto the circumference of the rotational element, and the circumferential surface is correspondingly designed. It can also be imagined that the grid is placed about the circumference of the rotational element and is pressed into the circumferential surface. This idea, consistently realized within the scope of the invention, leads in case of the preferred pair of rolling elements to the feature that the peripheral surface of the one element is reproduced as the positive form of the grid, and that of the other element is reproduced as the negative form of the grid. The rolling elements then are fashioned so that they roll over the grid without changing the grid structure. This means that it would be possible to place one rolling element onto one side of a grid panel (exhibiting the grid structure at the inlet to the respective conveyor) and to place the other rolling element onto the other side of the grid panel, and each of the two rolling elements could then be rolled over the respective side of the grid panel, in which case the positive-form circumferential surface of one rolling element would engage into the grid panel, and the grid panel, in turn, would engage into the negative-form circumferential surface of the other rolling element.

This, as mentioned above, is the consistent-theoretical conversion of the idea. However, it is also possible to do without a complete reproduction and to image only portions of the grid structure, namely those where it is intended for the conveyors to engage. This has been realized in the above-described embodiment of the toothed disks 33–38 where engagement of the conveyors is desired only at the grid nodal points: on the one hand with a view toward the cutouts or cutout spaces 4, 14 facilitating engagement into the length of material or grid 2, 12 without damage, on the other hand on account of the desired grid structure 12, attainable by exclusive pull at the central, flat regions of the grid nodal areas 16. The idea of reproducing the grid structure onto the circumference of the rotational conveyor element and its rolling along on the grid panel (in the manner of an involute) can be realized, depending on the grid structure desired, in a great variety of ways, i.e. this is neither limited to the toothed disk arrangement nor to the total reproduction of the grid onto the rolls, but also permits a great variety of different intermediate solutions.

The circumferential surfaces can also be designed differently from an exact adaptation to the grid structure 12 automatically obtained by the pull exerted on the length of material 2. For these surfaces can be fashioned—within certain limits— in correspondence with a desired grid structure deviating from the grid structure automatically obtained by the pulling action. With circumferential roll surfaces fashioned in such a way, the grid length will then be transformed and/or sized during passage through the conveyor in correspondence with the desired grid structure. Transforming or sizing can also take place with the aid of one (or several) sizing means rotating at the same or an increased peripheral speed with respect to the preceding conveyor.

We claim:

1. A process for producing expanded mesh grids, comprising providing a length of material with staggered cuts therein, conveying said length of material transversely to said staggered cuts, at a first speed with first conveying means, engaging the staggered cuts in said length of material with projection means on a second conveying means spaced from said first conveying means, and pulling said length of material by conveying said length of material transversely to said cuts with said second conveying means at a second speed that is grater than said first speed, thereby continuously stretching said length of material between the first and second conveying means into a three-dimensional expanded mesh grid.

2. A process for producing expanded mesh grids according to claim 1, wherein said length of material is a length of sheet metal.

3. A process for producing expanded mesh grids according to claim 1, including allowing said length of material to freely continuously travel between said first conveying means and said second conveying means.

4. A process for producing expanded mesh grids according claim 1, including engaging the staggered cuts in said length of material with projection means on a third conveying means spaced downstream from said second conveying means, and pulling said length of material by conveying said length of material transversely to said cuts with said third conveying means at a third speed that is greater than said second speed, thereby further stretching said length of material between the second and third conveying means into a three-dimensional expanded mesh grid.

5. A process for producing expanded mesh grids according to claim 1, in which said engaging of the staggered cuts by said second conveying means is provided by penetrating the staggered cuts in said length of material with projections on the circumference of said second conveying means.

6. A process for producing expanded mesh grids according to claim 4, in which each said engaging step is respectively provided by penetrating the staggered cuts in said length of material with projections on said second conveying means and projections on said third conveying means.

7. A process for producing expanded mesh grids according claim 1, in which said length of material is simultaneously conveyed at said first speed and said second speed.

8. A process for producing expanded mesh grids, comprising making staggered cuts throughout a length of material, conveying said length of material transversely to said staggered cuts, at a first-speed with first conveying means, engaging the staggered cuts in said length of material with projection means on a second conveying means spaced from said first conveying means, and pulling said length of material by conveying said length of material transversely to said cuts with said second conveying means at a second speed that is grater than said first speed, thereby continuously stretching said length of material between the first and second conveying means into a three-dimensional expanded mesh grid.

9. A process for producing expanded mesh grids according to claim 8, including forming mesh grid nodal points between said staggered cuts, and engaging at least a portion of said mesh grid nodal points with said second conveying means.

10. A process for producing expanded mesh grids according to claim 9, said projection means on said second conveying means engaging said length of material only at said mesh grid nodal points.

11. A process for producing expanded mesh grids according to claim 9, and the space between adjacent staggered cuts forming grid web portions connected at said nodal points, and said projection means on said second conveying means engaging said length of material between said mesh grid nodal points and bending the four grid portions connected at each nodal point to inclined positions.

12. A process for producing expanded mesh grids according to claim 8, including adjusting said second speed relative to said first speed for adjusting the size and configuration of the three-dimensional expanded mesh grid.

13. Apparatus for the production of expanded mesh grid material from a length of material having staggered cuts therein transverse of the length of the material, comprising first conveying means adapted to operate at a first speed for conveying the length of material at said first speed, second conveying means spaced downstream from said first conveying means, projection means on the surface of said second conveying means for penetrating into the staggered cuts of the length of material, said second conveying means adapted to operate at a second speed that is greater than said first speed of said first conveying means, and said projection means pulling the length of material from said first conveying means, while conveying it at said second speed, for forming a three-dimensional expanded mesh grid.

14. Apparatus for the production of expanded mesh grid material according to claim 13, including third conveying means spaced downstream from said second conveying means for operating at a third speed that is greater than said second speed, second projection means on the surface of said third conveying means for penetrating into the staggered cuts of the length of material, whereby the length of material is conveyed in succession from said first conveying means to said second conveying means to said third conveying means at successively increased speed in the downstream conveying direction.

15. Apparatus for the production of expanded mesh grid material according to claim 13, in which at least one of said first and second conveying means includes a pair of cooperating rotational elements for engaging said length of material on opposite sides, and said projection means comprise meshing projections and recesses on said pair of cooperating rotational elements.

16. Apparatus for the production of expanded mesh grid material according to claim 13, in which grid nodal points, arranged in grid nodal rows, are provided between said staggered cuts in said length of material, at least one of said first and second conveying means comprises a plurality of toothed disks, corresponding to the number of grid nodal rows, connected in spaced relation on a common shaft, the teeth of said toothed disks having flank portions for rolling over the nodal points during rotation, whereby the mesh grid is retained at the nodal points and is continuously transported.

17. Apparatus for the production of expanded mesh grid material according to claim 16, in which the widths of said toothed disks, relative to the spacing of the toothed disks, is of a size so said flank portions of teeth engage only in a central, planar region of said nodal points.

18. Apparatus for the production of expanded mesh grid material according to claim 13, in which grid nodal points, arranged in grid nodal rows, are provided between said staggered cuts in said length of material, at least one of said first and second conveying means comprises a pair of cooperating rolling elements, at least portions of the expanded mesh grid structure being reproduced in three-dimensional form in each of said pair of cooperating rolling elements, in negative form in one rolling element of said pair of rolling elements and in positive form in another rolling element of said pair of rolling elements, whereby the expanded mesh grid structure is held and conveyed continuously between the oppositely rotating pair of cooperating rolling elements.

19. Apparatus for the production of expanded mesh grid material according to claim 18, in which said pair of cooperating rolling elements comprise two rolls with the complete expanded mesh grid structure reproduced in three-dimensional negative form on one roll of said two rolls and in three-dimensional positive form on the other roll of said two rolls.

20. Apparatus for the production of expanded mesh grid material according to claim 13, including at least one rotating sizing means spaced downstream from said second conveying means for sizing of at least one parameter of said expanded mesh grid structure into the selected final mesh grid shape.

21. Apparatus for the production of expanded mesh grid material according to claim 20, in which said rotating sizing means comprises a pair of cooperating roll means including first and second roll means, and portions of the expanded mesh grid structure to be sized being reproduced in positive three-dimensional form on said first roll means, and in negative three-dimensional form on said second roll means.

22. Apparatus for the production of expanded mesh grid material according to claim 20, in which said three-dimensional expanded mesh grid includes a selected mesh grid height, said rotating sizing means comprising first and second rotating cylindrical jacket means mutually spaced by the distance of said selected mesh grid height from each other, and said length of expanded mesh grid material being passed between said first and second rotating cylindrical jacket means for calibration of the grid height of said length of expanded mesh grid material.

23. Apparatus for the production of expanded mesh grid material according to claim 20, in which said three-dimensional expanded mesh grid includes a selected mesh grid height, said rotating sizing means comprising a further conveying means including a pair of counter-rotating substantially cylindrical members, toothed disks connected respectively on said pair of cylindrical members, said pair of cylindrical members being spaced from each other by the distance of said selected mesh grid height, whereby said length of expanded mesh grid material is retained and transported and its height is simultaneously adjusted.

24. Apparatus for the production of expanded mesh grid material according to claim 13, in which said first conveying means includes at least one rotatable element having a circumferencial surface, and first projection means connected on said circumferential surface for penetrating into and engaging the staggered cuts of the length of material.

* * * * *